US008528970B2

(12) United States Patent
Edalati et al.

(10) Patent No.: US 8,528,970 B2
(45) Date of Patent: Sep. 10, 2013

(54) MULTI-ADJUSTABLE BODY-REST APPARATUS

(76) Inventors: Mohsen Edalati, Bothell, WA (US); Hoda Edalati, Bothell, WA (US)

( * ) Notice: Subject to any disclaimer, the term of this patent is extended or adjusted under 35 U.S.C. 154(b) by 314 days.

(21) Appl. No.: 13/007,899

(22) Filed: Jan. 17, 2011

(65) Prior Publication Data

US 2012/0181821 A1 Jul. 19, 2012

(51) Int. Cl.
*A47B 83/02* (2006.01)

(52) U.S. Cl.
USPC ..... 297/163; 297/394; 297/403

(58) Field of Classification Search
USPC ..... 297/163, 169, 394, 403
See application file for complete search history.

(56) References Cited

U.S. PATENT DOCUMENTS

| | | | | |
|---|---|---|---|---|
| 245,639 | A * | 8/1881 | Lay | 297/394 |
| 1,260,929 | A * | 3/1918 | Maxcy | 297/394 |
| 2,173,569 | A * | 9/1939 | Troendle | 297/146 |
| 3,544,161 | A * | 12/1970 | Bryden | 297/391 |
| 4,182,322 | A | 1/1980 | Miller | |
| 5,370,446 | A | 12/1994 | Bancod | |
| 5,505,523 | A | 4/1996 | Wang | |
| 5,611,601 | A | 3/1997 | Cowgur | |
| 5,645,319 | A | 7/1997 | Parks, Jr. | |
| 6,033,023 | A | 3/2000 | Strassner | |
| 6,494,531 | B1 | 12/2002 | Kim | |
| 6,619,733 | B2 | 9/2003 | Pearson | |
| 6,647,573 | B2 * | 11/2003 | Corbin | 5/655.3 |
| 6,805,403 | B2 * | 10/2004 | Buch | 297/146 |
| 6,857,149 | B2 * | 2/2005 | Hoggatt et al. | 5/632 |
| 7,673,836 | B2 * | 3/2010 | Wallock et al. | 248/118 |
| 2005/0179300 | A1 | 8/2005 | O'Connor et al. | |
| 2008/0303318 | A1 * | 12/2008 | Hamilton | 297/129 |

* cited by examiner

*Primary Examiner* — David Dunn
*Assistant Examiner* — Philip Gabler

(57) ABSTRACT

A method and a device are disclosed for a multi-adjustable body-rest structure suitable for use in a sitting position, including sitting positions in a multi-row seating arrangement such as those encountered on board of airplanes, busses, ferries, and trains, among other similar arrangements. The multi-adjustable body-rest structure is generally configured to be used for rest or sleep while leaning forward from the user seat onto the back of the seat in front of the user seat. The multi-adjustable body-rest structure is further configured to be folded into the back of the seat in front of the user seat when not in use. The multi-adjustable body-rest structure is further configured to be adjusted to a position that comfortably accommodates the head, chest, and arms of users with different body sizes.

20 Claims, 4 Drawing Sheets

MULTI-ADJUSTABLE BODY-REST APPARATUS

TECHNICAL FIELD

This application relates generally to body rests. More specifically, this application relates to a method and apparatus for a multi-adjustable head and body support configured to be used for resting and/or sleeping in a sitting position.

SUMMARY

In aspects of present disclosure, a body-rest apparatus is disclosed including an adjustable head support component, and an adjustable chest support component coupled with the head support component, the chest support component configured to be used by a user to rest while leaning forward.

In further aspects of the present disclosure, a portable body-rest apparatus is disclosed including an adjustable head support component, an adjustable chest support component coupled with the head support component, the chest support component configured to be used by a user to rest while leaning forward, and a vertical platform coupled with at least with one of the head support component and chest support component, the vertical platform configured to be coupled with a front seat in front of the user.

In still further aspects of the present disclosure, a method of enabling a user to rest is disclosed including enabling the user to lean forward onto a head support component and a chest support component, enabling the user to adjust the head support component and the chest support component to substantially align the user's neck and back, and enabling the user to fold away the head support component and the chest support component.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
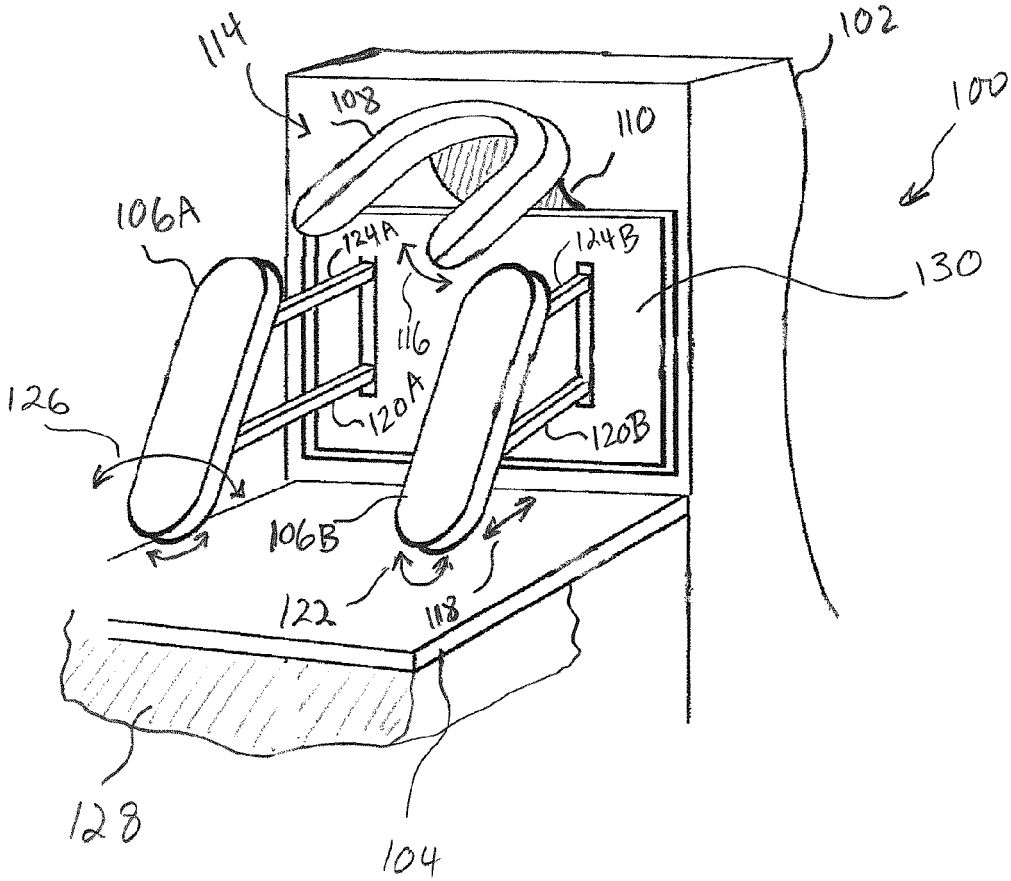
FIG. 1 shows a perspective view of an example body-rest structure suitable for use in a sitting position.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed.

Briefly described, a method and a device are disclosed for a multi-adjustable body-rest structure suitable for use in a sitting position, including sitting positions in a multi-row seating arrangement such as those encountered on board of airplanes, busses, ferries, and trains, among other similar arrangements. The multi-adjustable body-rest structure is generally configured to be used for rest or sleep while leaning forward from the user seat onto the back of the seat in front of the user seat. The multi-adjustable body-rest structure is further configured to be folded into the back of the seat in front of the user seat when not in use. The multi-adjustable body-rest structure is further configured to be adjusted to a position that comfortably accommodates the head, chest, and arms of users with different body sizes.

With the advent of ubiquitous global communications, international business trips, vacation packages, and family trips have actually increased due to increased contact and interdependency between people. A side effect of this increase in travel is that transportation vehicles, such as airplanes, busses, trains, ferries, passenger cars, and the like have more cramped seating compared with a few years ago to accommodate ever more passengers in a cost-effective manner. Additionally, due to security concerns and resulting procedures, crowded airports and other transportation stations a trip can be a tiring experience. Accordingly, it is desirable to have a restful travel experience when passengers settle in their seats towards their destination. With cramped and limited space for each passenger, efficient, effective, and practical devices that accommodate resting and/or sleep for passengers in their seats are highly desirable.

Many forms and varieties of head rests are available for different sitting positions. For example, doughnut shaped neck pillows are available for resting neck and head in a sitting position while leaning back against the seat's back. Other head and neck restraint systems are known, which support the user's head and neck while sleeping or resting and leaning back on the seat. Such restraint systems generally use side pads and/or straps to limit the motion of the user's head and neck while resting and/or sleeping. Bean-bag type of pillows or are also used to lean against in a forward or backward leaning position while resting the head.

These apparatuses generally lack ergonomic features for supporting not only head and neck but also upper body and spine, which tend to curve and cause back aches when the user is sleeping. They also lack comprehensive adjustability for different dimensions, angles, and positions. For example, a bean-bag type pillow's size does not adjust to accommodate different size users. It also lacks rigid support for spine or head to hold them in a desired ergonomic position. Similarly, other head restraint devices lack support for keeping the neck and back (spine) in alignment to prevent pain or injury as a result of such misalignment.

FIG. 1 shows a perspective view of an example body-rest structure suitable for use in a sitting position. In various embodiments, body-rest apparatus 100 is coupled with front seat 102 via a vertical platform 130 and includes a substantially horizontal member 104, chest support components 106A and 106B supported by chest structural members 120A, 124A and 120B, 124B, respectively, a U-shaped head support component 108 coupled with head structural member 110, and arm support component 128 coupled with horizontal member 104. Each of the body rest components, including at least head support component 108 and chest support components 106A and 106B, may be independently adjusted by a user of the body rest apparatus, typically sitting in a seat directly behind front seat 102, in various ways. For example, in some embodiments, chest support components 106A and 106B may be adjusted by changing tilt angle as indicated by arrow 122.

Chest support components 106A and 106B may further be independently adjusted by changing the lengths of the chest structural members 120A, 120B, 124A, and 124B. In some embodiments, the chest structural members are telescopic or otherwise adjustable and may be adjusted equally to move chest support components 106A and 106B closer and farther away from front seat 102, in the direction indicated by arrow 118. By increasing the length of chest structural members 124A and 124B relatively more than the length of chest structural members 120A and 120B, respectively, the tilt angle of chest support members 106A and 106B may be increased, making chest support components closer to the vertical with respect to horizontal member 104. Conversely, by increasing the length of chest structural members 124A and 124B relatively less than the length of chest structural members 120A and 120B, respectively, the tilt angle of chest support components 106A and 106B may be decreased, making chest support components closer to the horizontal with respect to horizontal member 104.

Chest support components 106A and 106B may further be angularly adjusted from side-to-side with respect to each other, as indicated by arrow 126, to form a substantially convex or concave support surface for the chest. Additionally, chest support components 106A and 106B may be adjusted to move towards each other or away from each other in parallel, effectively varying the width of the chest support surface formed by both chest support components 106A and 106B. In various other embodiments, chest support components 106A and 106B may be integrated as a single wider chest support component with angular and translational adjustments similar to those described above.

In various embodiments, head support component 108 is coupled to body-rest apparatus 100 via a head structural member 110, which may be adjusted up or down and from side to side with respect to front seat 102 to accommodate an orientation of the user's head while resting or sleeping. In various embodiments, head support component 108 includes a soft and supple foam, soft rubber, padding, or other similar material to comfortably support head and face in a downwards position. In some embodiments, head support component 108 may be adjusted by tilting up or down as shown by the directional arrow 116 to support neck tilt. In some embodiments, the various adjustments described above are deliberately made by the user by using adjustment devices or mechanisms such as screws, sliders, telescopic arms, pivots, ratchet mechanisms, buckles, and the like, to move and position different components and members with respect to each other, while in other embodiments, at least some of the adjustments are friction based and take place automatically in reaction to forces exerted by user's body.

The head support component 108 may be held in a particular position by friction adjusted to a predetermined force level. When a force is exerted against the head support component that is sufficient to overcome the predetermined force level, the head support component begins to move further in response to and in the direction of the exerted force. For example, the predetermined force level may be sufficient to support the weight of the head and neck of the user while resting, but may give way in a desired direction if the user exerts slightly more force by his head to move or reposition the head support component. Similar friction-based techniques may be used to adjust other components, such as the chest support components.

In various embodiments, user's arms may be rested on the horizontal member while the user is leaning and resting on the head and chest support components. For example, the user's arms may be folded forward under chest support components 106A and 106B from opposite sides. In other embodiments, the user's arms may be supported by an adjustable arm support component 128. In some embodiments, arm support component 128 includes a flexible membrane hanging under horizontal member 104, such as canvas or leather, for resting arms, while in other embodiments, arm support component 128 includes a foldable rigid box compartment under horizontal component 104 for resting the arms. Arm support component 128 may be adjusted by adjusting the size of the hanging membrane or the size of the foldable box to allow the arms to hang down to a predetermined extent.

In various embodiments, head support component 108 and chest support components 106A and 106B may be positioned with respect to each other to allow alignment of the user's spine while resting. The rigid structure of head support component 108 and chest support components 106A and 106B allows reliable and firm positioning of these components to maintain the alignment of the user's spine without having to readjust due to unwanted movement of these components.

In various embodiments, horizontal member 104 may be used as a tray for serving food or holding objects such as books and purses, while chest and head support components are folded into the back of the front seat. In some embodiments, body-rest apparatus 100 is folded flat onto vertical platform 130 by folding chest support components 106A, 106B, and folding chest structural members 120A, 120B, 124A, and 124B. Head support component 108 and head structural member 110 are similarly folded down flat onto vertical platform 130. Finally, horizontal member 104 along with arm support component 128 are folded up against vertical platform 130 to present a substantially flat back of front seat 102 to the user.

Those skilled in the art will appreciate that many other folding scenarios of components are possible without departing from the spirit of the present disclosures. In some embodiments, body-rest apparatus 100 and vertical platform 130 are integrated as one package that may be installed in a recession in the back of the front seat in a permanent or temporary configuration. In other embodiments, body-rest apparatus 100 and vertical platform 130 are attached to the back of the front seat using other techniques, as further described with respect to FIG. 4.

Figure 2:
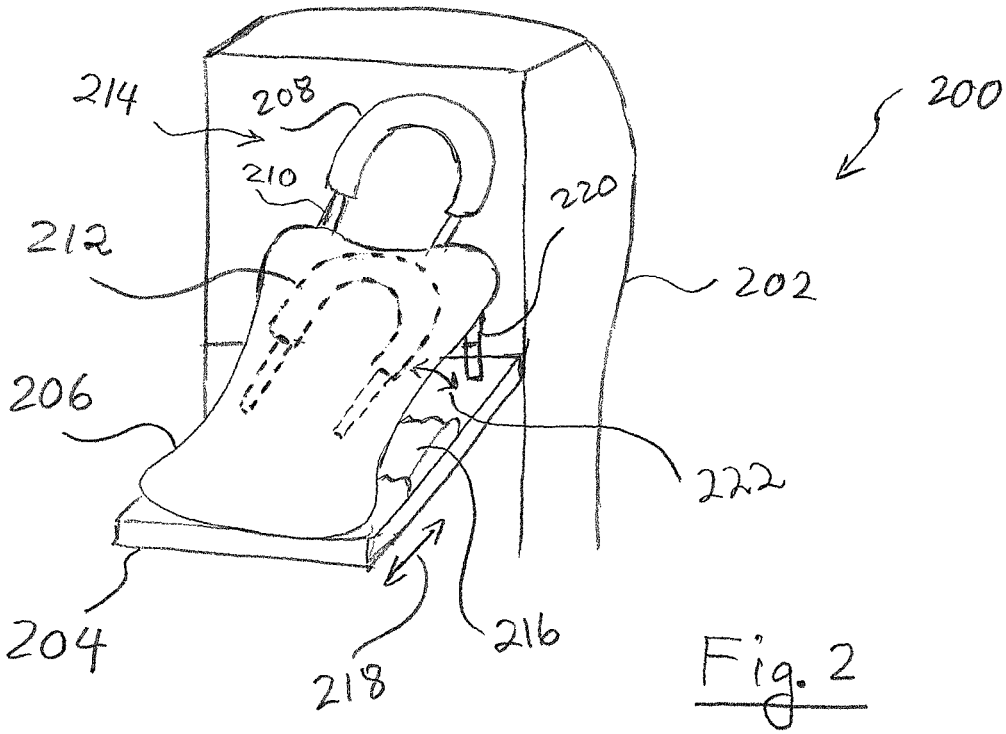
FIG. 2 shows a perspective view of another example body-rest structure suitable for use in a sitting position.

FIG. 2 shows a perspective view of another example body-rest structure suitable for use in a sitting position. In various embodiments, body-rest apparatus 200 is attached to the back of front seat 202 and includes a substantially horizontal member 204, chest support component 206, head support component 208 coupled with head structural member 210, arm support component 216, and structural leg 220.

In various embodiments, chest support component is coupled to a sliding head support component 208 via head structural member 210. The size of head support is determined at least by the extent to which head support component 208 slides outwards with respect to chest support component 206. Head support component 208 and head structural member 210 slide together and hide within chest support component 206 for storage. In various embodiments, head support component 208 includes a soft and supple foam, soft rubber, padding, or other similar material to comfortably support head and face in a downwards position.

In some embodiments, chest support component 206 is coupled with structural leg 220, the length of which is adjustable, by being telescopic or otherwise adjustable. By adjusting the length of structural leg 220 an angle of chest component 206 may be adjusted, as indicated by arrow 222, to accommodate different degrees of tilt for the user's upper body. Additionally, the sliding and rigid coupling between head support component 208 and chest support component 206 allows alignment of user's spine while resting.

In various embodiments, horizontal member 204 includes sliding plates or other similar mechanisms to allow adjustment of a length of horizontal member 204 by sliding inwards and outwards with respect to the back of the front seat to accommodate different body sizes of different users.

In various embodiments, horizontal member 204 includes a padded arm support component 216 for resting the user's arm while leaning forward against chest and head support components. In other embodiments, arm support component 216 is implemented as a hanging compartment under horizontal member 204, similar to that shown in FIG. 1.

In various embodiments, body-rest apparatus 200 may be folded up into the back of the front seat by sliding head support component 208 into chest support component 206, reducing length of support leg 220 to a substantially minimal size, and flipping up horizontal member 204 to be held against the back of front seat 202.

Figure 3:
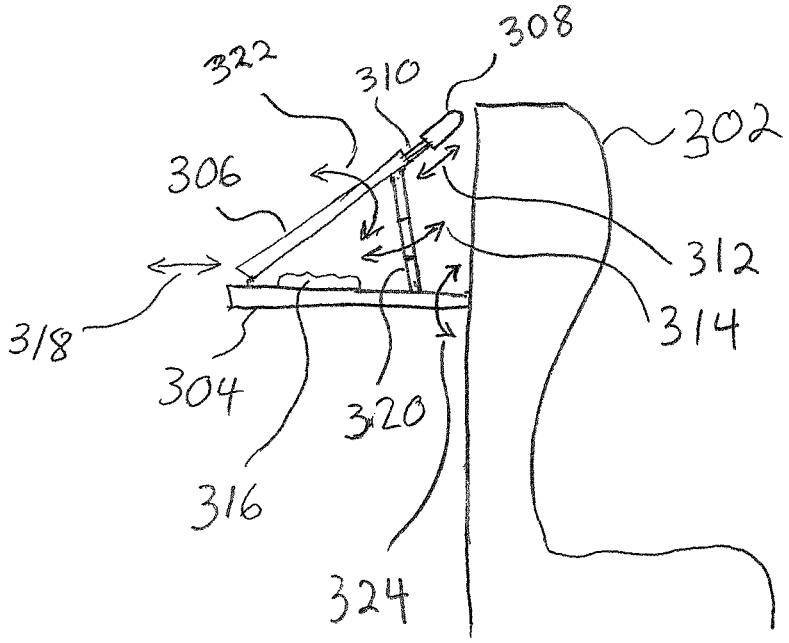
FIG. 3 shows a side view of the example body-rest structure of FIG. 2.

FIG. 3 shows a side view of the example body-rest structure of FIG. 2. In various embodiments, body-rest apparatus attached to front seat 302 includes chest support component 306, which is coupled with head support component 308 via head structural member 310 and structural leg 320. Horizontal member 304 includes arm support component 316 and is coupled with chest support component 306.

In various embodiments, multiple adjustments may be made to each component of the body-rest apparatus. Tilt angle of chest support component 306 may be adjusted, as indicated by arrow 322 by adjusting the length or angle of structural leg 320, as indicated by arrow 314. Horizontal member 318 may also be adjusted by sliding it in or out with respect to front seat 302. Head support component 308 may slide in and out along the surface of chest support component 306, as indicated by arrow 312.

In some embodiments, to fold up the body-rest apparatus completely out of the user's space in the seat behind the front seat, structural leg 320 is folded flat onto chest support component 306, head support component 308 is pushed downwards in parallel with the surface of chest support component 306, chest component 306 is folded down flat, as indicated by arrow 322, onto horizontal member 304, and horizontal member 304 is folded up and held flat against the back of front seat 302.

Figure 4:
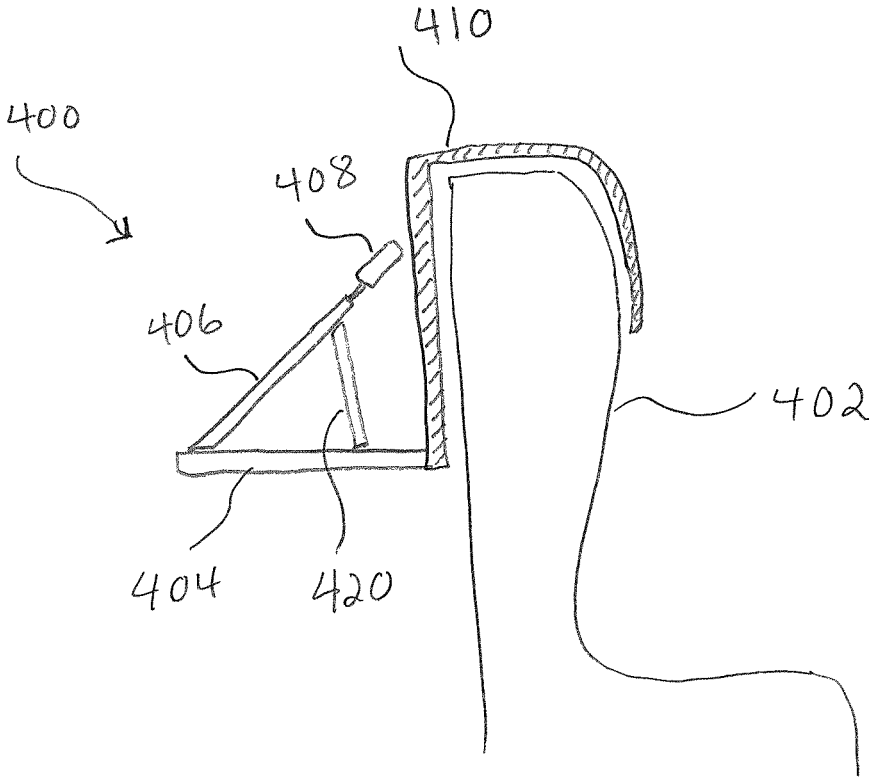
FIG. 4 shows an example portable body-rest structure.
Figure 5:
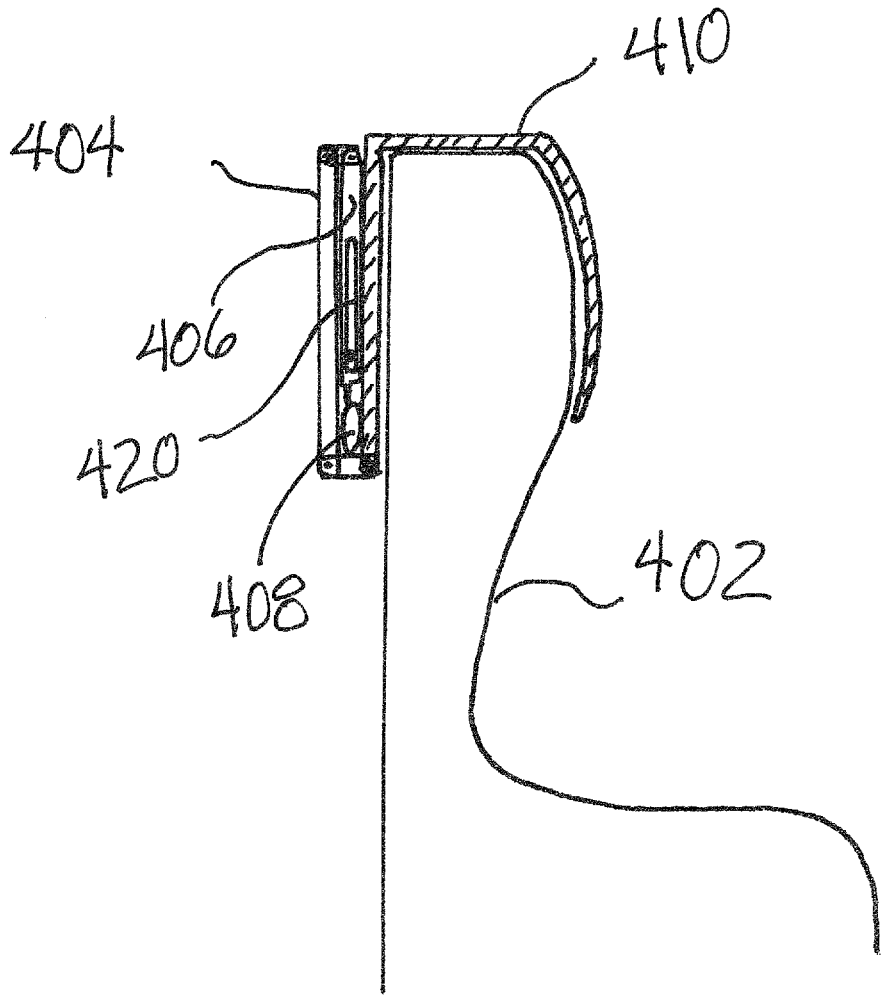
FIG. 5 shows an example portable body-rest structure in folded position.

FIG. 4 shows an example portable body-rest structure. In various embodiments, portable body-rest apparatus 400 includes chest support component 406, head support component 408, structural leg 420, and horizontal member 404 coupled with vertical platform 410.

In various embodiments, vertical platform 410 includes a curved section that may be hung over the top of front seat 420. In some embodiments, the back of front seat 420 includes a mechanical interface for attaching vertical platform 410, for example, using screws or other fasteners, such as hooks, buckles, mating sliders, and the like. Those skilled in the art will appreciate that other techniques may be used for attaching body-rest apparatus 400 to the back of front seat 402 without departing from the spirit of the present disclosures. For example, a hollow inset box space in the back of the front seat may be used to take in the body-rest apparatus 400 integrated into a foldable box.

Using such portable configurations, different types of body-rest apparatus may be installed on the same seat depending on the preferences of a commercial carrier such as an airline. Conversely, the same body-rest apparatus may be carried by a user to be used during a trip in the back of a passenger car, a bus, an airplane, and the like.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A body-rest apparatus comprising:

an adjustable head support component; and an adjustable chest support component coupled with a horizontal platform and with the head support component, wherein the head support component is adjustable relative to the chest support component, the chest support component configured to be used by a user to rest while leaning forward, wherein the head support component and the chest support component are configured to be folded flat against and be attached permanently or removably to a back surface of a seat in front of the user.

2. The body-rest apparatus of claim 1, further comprising an adjustable arm support component coupled with chest support component.

3. The body-rest apparatus of claim 1, further comprising a substantially horizontal member coupled with the chest support component and the head support component.

4. The body-rest apparatus of claim 3, wherein the substantially horizontal member is configured to be used as a tray for the user.

5. The body-rest apparatus of claim 3, wherein the substantially horizontal member is configured to be used as an arm support component.

6. The body-rest apparatus of claim 1, further comprising a vertical platform configured to attach to at least the chest support component and to a back surface of a front seat.

7. The body-rest apparatus of claim 1, wherein the head support component includes an adjustable angle.

8. The body-rest apparatus of claim 1, wherein the head support component is U-shaped and is configured to support the user's head in a face-down position.

9. The body-rest apparatus of claim 1, wherein the chest support component includes two segments, each of the two segments being independently adjustable.

10. The body-rest apparatus of claim 1, wherein the chest support component is coupled to a chest structural member with adjustable length.

11. The body-rest apparatus of claim 1, wherein the body-rest apparatus is used in a passenger car, a bus, or an airplane.

12. A portable body-rest apparatus comprising:

an adjustable head support component;

an adjustable chest support component coupled with the head support component wherein the head support component is adjustable relative to the chest support component, the chest support component configured to be used by a user to rest while leaning forward; and a vertical platform coupled with at least one of the head support component and chest support component, the vertical platform configured to be detachably coupled with a front seat in front of the user, wherein the head support component and the chest support component are configured to be folded flat against and be attached permanently or removably to the vertical platform.

13. The portable body-rest apparatus of claim 12, further comprising an arm support component.

14. The portable body-rest apparatus of claim 12, further comprising a telescopic support leg coupled with the chest support component.

15. The portable body-rest apparatus of claim 12, further comprising a substantially horizontal member coupled with the chest support component.

16. The portable body-rest apparatus of claim 12, wherein the head support component is slideably coupled with the chest support component.

17. The portable body-rest apparatus of claim 12, wherein the vertical platform includes a bent section for hanging from a back of the front seat.

18. The portable body-rest apparatus of claim 12, wherein the portable body-rest apparatus is used in a passenger car, a bus, or an airplane.

19. A method of enabling a user to rest, the method comprising:

enabling the user to detachably couple a head support component, a horizontal platform, and a chest support component with a front seat in front of the user, wherein the head support component is adjustable relative to the chest support component;

enabling the user to lean forward onto the head support component and the chest support component;

enabling the user to adjust the head support component and the chest support component to substantially align the user's neck and back; and enabling the user to fold away the head support component and the chest support component.

20. The method of claim 19, further comprising enabling the user to rest the user's arms on an arm support component while resting on the head and chest support components.

* * * * *